US008342658B2

(12) United States Patent
Tsuchii et al.

(10) Patent No.: US 8,342,658 B2
(45) Date of Patent: Jan. 1, 2013

(54) INK JET PRINT HEAD

(75) Inventors: Ken Tsuchii, Sagamihara (JP); Masataka Sakurai, Kawasaki (JP); Yoshiyuki Nakagawa, Kawasaki (JP); Akiko Saito, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 250 days.

(21) Appl. No.: 12/697,742

(22) Filed: Feb. 1, 2010

(65) Prior Publication Data

US 2010/0201754 A1 Aug. 12, 2010

(30) Foreign Application Priority Data

Feb. 6, 2009 (JP) ..... 2009-026169
Jan. 18, 2010 (JP) ..... 2010-007994

(51) Int. Cl.
*B41J 2/05* (2006.01)

(52) U.S. Cl. ..... 347/65; 347/54

(58) Field of Classification Search ..... 347/54, 347/65

See application file for complete search history.

(56) References Cited

U.S. PATENT DOCUMENTS

| | | | | |
|---|---|---|---|---|
| 4,683,481 | A | 7/1987 | Johnson | |
| 4,896,171 | A | 1/1990 | Ito | |
| 5,126,768 | A | 6/1992 | Nozawa et al. | |
| 5,182,577 | A | 1/1993 | Ishinaga et al. | |
| 6,113,220 | A | 9/2000 | Ishinaga et al. | |
| 6,162,589 | A | 12/2000 | Chen et al. | |
| 6,174,049 | B1 * | 1/2001 | Tachihara et al. | 347/65 |
| 6,273,557 | B1 | 8/2001 | Milligan et al. | |
| 6,303,274 | B1 | 10/2001 | Chen et al. | |
| 6,394,588 | B2 * | 5/2002 | Moon et al. | 347/65 |
| 6,447,102 | B1 | 9/2002 | Chen et al. | |
| 6,481,819 | B2 | 11/2002 | Kaneko et al. | |
| 6,557,983 | B1 * | 5/2003 | Inoue | 347/65 |
| 6,918,657 | B2 | 7/2005 | Kawamura et al. | |
| 2002/0015080 | A1 | 2/2002 | Moon et al. | |

FOREIGN PATENT DOCUMENTS

| | | |
|---|---|---|
| EP | 0 393 855 A1 | 10/1990 |
| EP | 1 078 754 | 2/2001 |
| JP | 2001-071502 | 3/2001 |
| KR | 10-0406946 | 11/2003 |
| RU | 2221701 C2 | 1/2004 |

* cited by examiner

*Primary Examiner* — Geoffrey Mruk
(74) *Attorney, Agent, or Firm* — Fitzpatrick, Cella, Harper & Scinto

(57) ABSTRACT

An ink jet print head is provided which can improve throughput by increasing an ink ejection frequency and prevent crosstalk among a plurality of heat application portions, realizing a capability of printing high-quality images at high speed. An opening size of the supply ports in a direction perpendicular to the array direction of the heat application portions is made greater than the length in the direction of electrothermal conversion elements. The supply ports are arranged along the array direction so that they adjoin the heat application portions in the array direction.

19 Claims, 20 Drawing Sheets

INK JET PRINT HEAD

BACKGROUND OF THE INVENTION

1. Field of the Invention

The present invention relates to an ink jet print head that uses heat of an electrothermal conversion element for ejecting ink accommodated in a heat application portion (or pressure chamber) from an ejection opening.

2. Description of the Related Art

EP 1 078 754 discloses an ink jet print head that has two ink supply ports for one ejection opening and in which the ink supplied into a heat application portion through these ink supply ports is ejected from the ejection opening by using heat generated by an electrothermal conversion element. The ink supply ports are formed to be smaller than the ejection opening to prevent foreign matter from entering the heat application portion.

An ink supply port that is smaller than an ejection opening, can prevent foreign substances from getting into the heat application portion, but increases the flow resistance of ink when the ink is supplied again through the ink supply port into the heat application portion after ink ejection (also referred to as a "refill"). So, the ink ejection frequency cannot be increased, making it impossible to enhance the throughput.

SUMMARY OF THE INVENTION

The present invention provides an ink jet print head that can increase the ink ejection frequency to improve the throughput and at the same time reduce the influence of the pressure among a plurality of heat application portions at the times of ink ejection, or so-called crosstalk, thus enabling high-quality images to be printed at high speed.

According to an aspect of the present invention, there is provided an ink jet print head having a plurality of heat application portions and a plurality of supply ports, wherein each of the heat application portions is supplied with ink from at least one of the supply ports and ejects the supplied ink from an associated ejection opening by using thermal energy of an electrothermal conversion element, wherein one or more heat application portions are arrayed alternately with a supply port in a predetermined direction. Further, the opening size of at least one of the supply ports, in a direction perpendicular to the predetermined direction, is greater than the length of the electrothermal conversion elements in the direction perpendicular to the predetermined direction.

With this invention, the opening size of a supply port in a direction perpendicular to a direction of array of heat application portions is made larger than the length of an electrothermal conversion element in the direction perpendicular to the heat application portion array direction. This arrangement can reduce the ink flow resistance when ink is refilled into the heat application portions, which in turn, allows the ink ejection frequency to be increased, improving throughput. Further, by arranging a plurality of the supply ports, whose opening size is set as described above, along the array direction of heat application portions and putting them next to (between) the heat application portions in the heat application portion array direction, the pressure in the heat application portions can be absorbed effectively by the supply ports to reduce crosstalk among the plurality of heat application portions. This in turn, allows for printing high-quality images at high speed.

Further features of the present invention will become apparent from the following description of exemplary embodiments (with reference to the attached drawings).

DESCRIPTION OF THE EMBODIMENTS

Before proceeding to detailed explanation of the embodiments of this invention, an example construction of an ink jet printing apparatus that can apply the ink jet print head of this invention will be described.

(Example Construction of Ink Jet Printing Apparatus)

Figure 13:
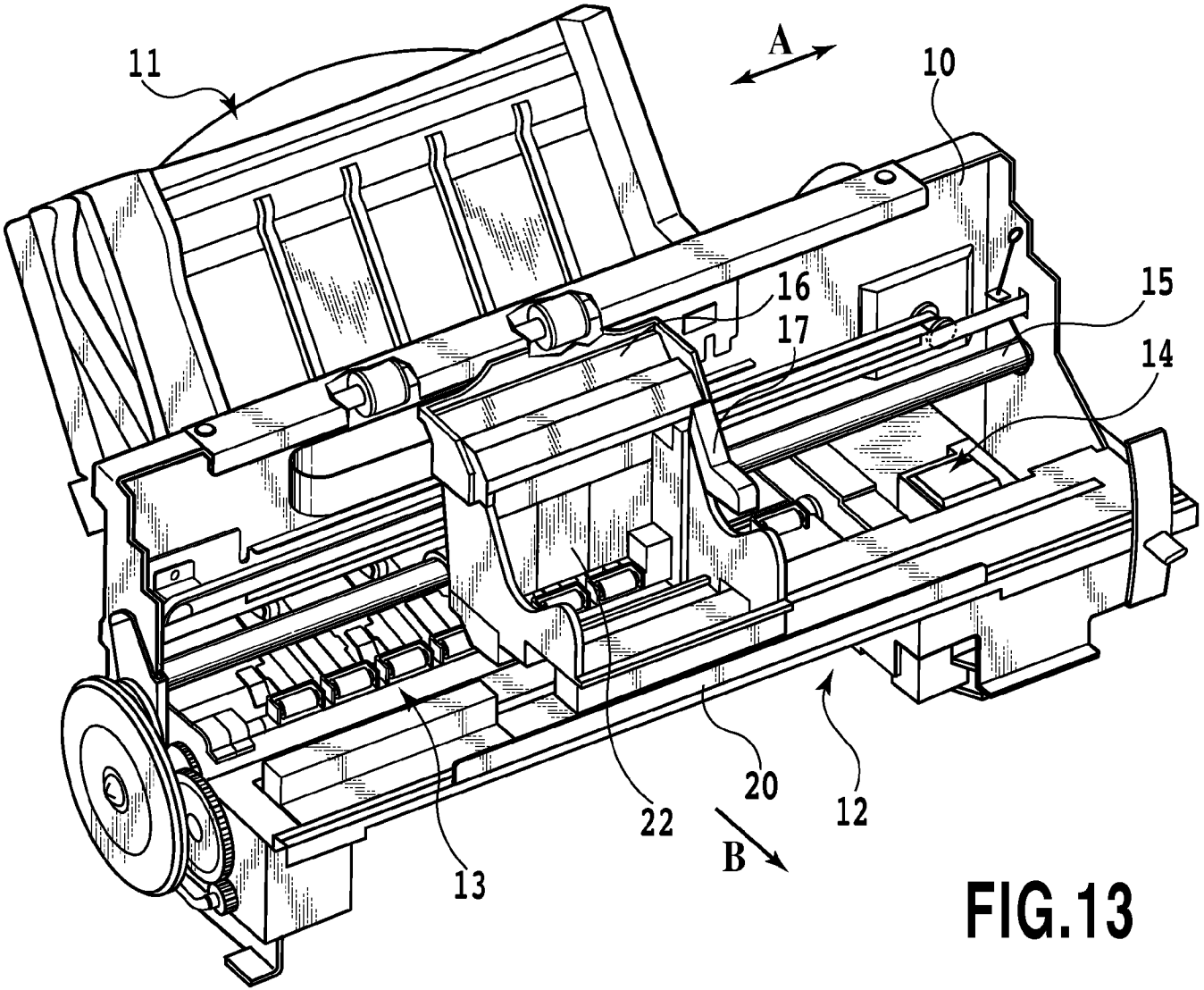
FIG. 13 is an outline perspective view of an ink jet printing apparatus that can apply the present invention.
Figure 14:
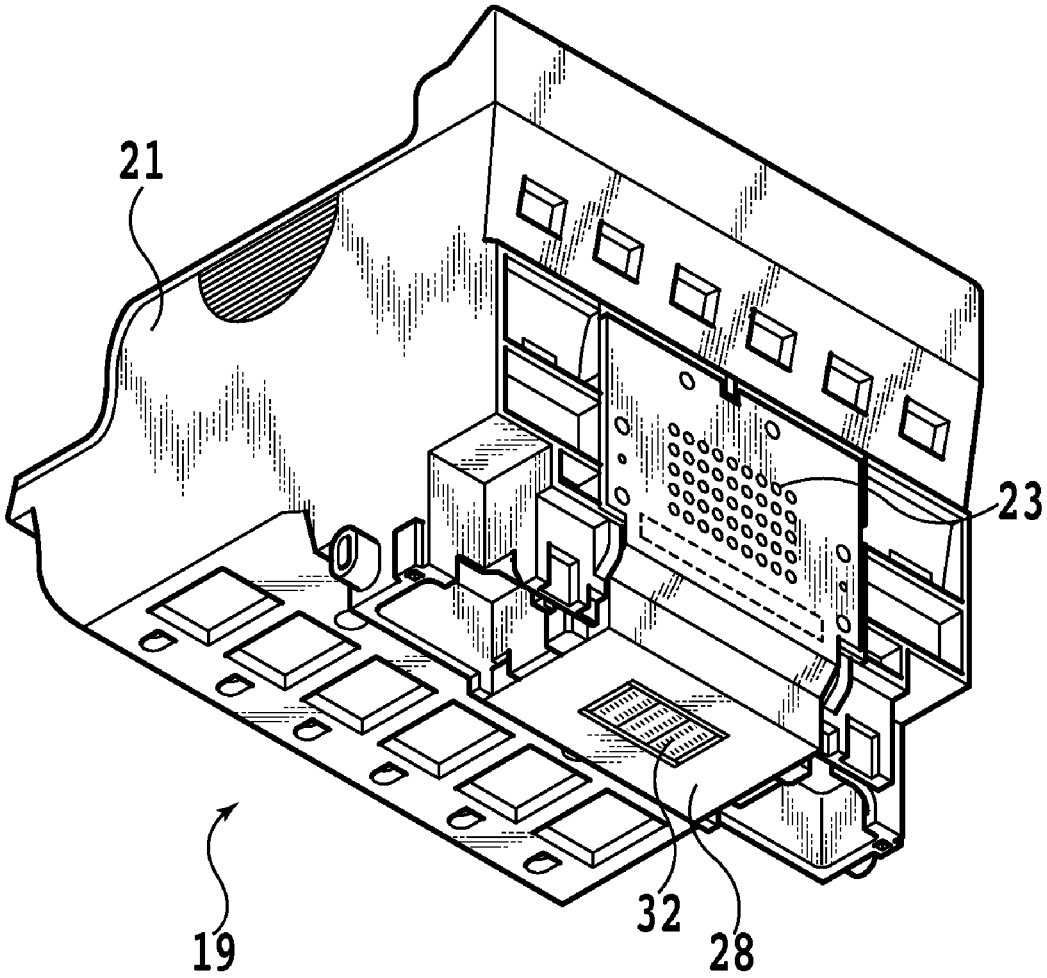
FIG. 14 is a perspective view, as seen from below, of a head cartridge that can be mounted on the ink jet printing apparatus of FIG. 13.
Figure 15:
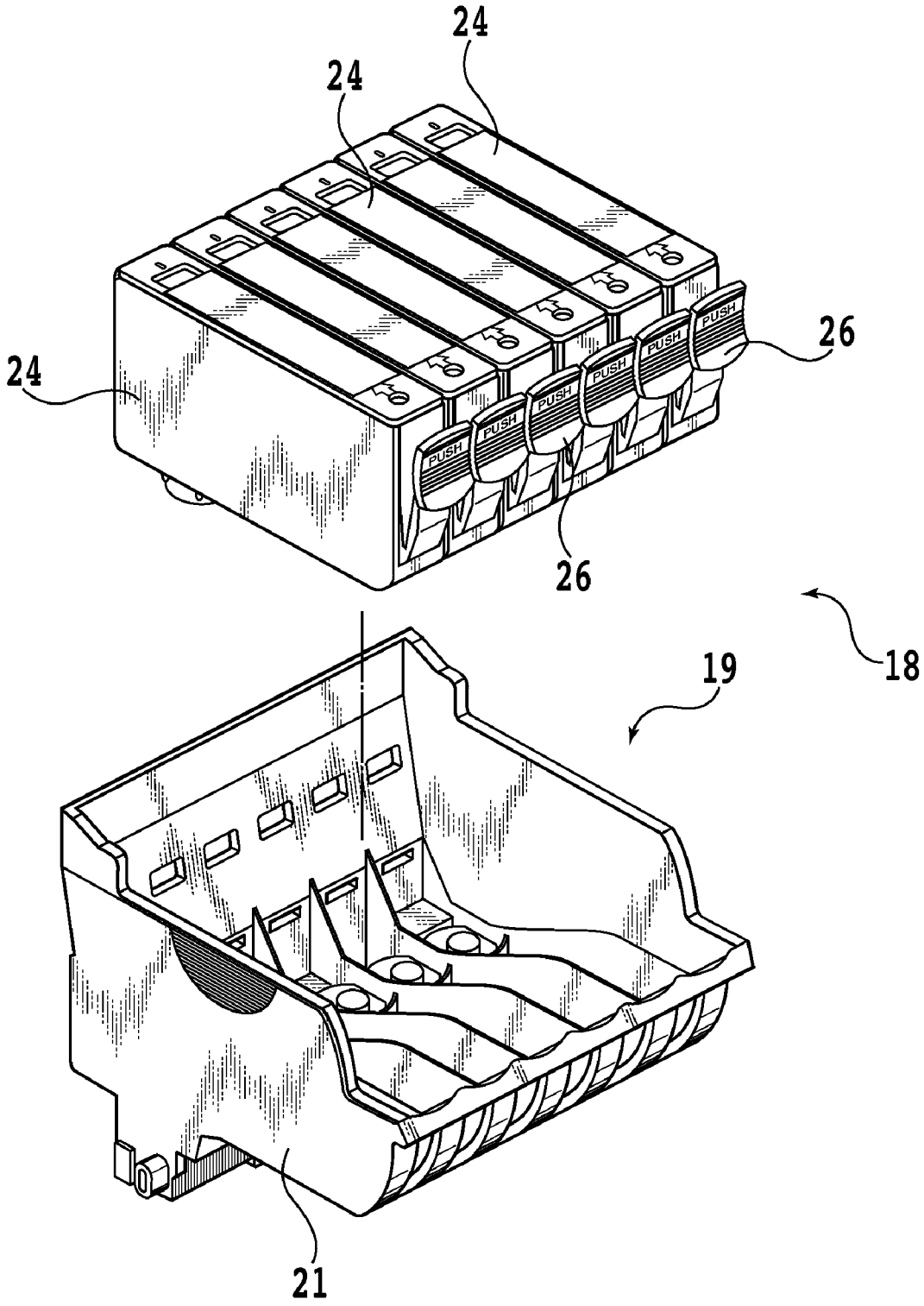
FIG. 15 is an exploded perspective view of the head cartridge of FIG. 13, as seen from above.

FIG. 13 is an outline perspective view of a mechanical structure of the ink jet printing apparatus that can apply the ink jet print head of this invention. FIG. 14 is an outline perspective view of a head cartridge used in the ink jet printing apparatus. FIG. 15 is an outline perspective view of an ink tank to be mounted on the head cartridge.

A chassis 10 in the ink jet printing apparatus of this embodiment is formed of a plurality of platelike metal members with a predetermined stiffness and constitutes a framework of this ink jet printing apparatus. On the chassis 10 are mounted a medium supply unit 11, a medium transport unit 13, a printing unit and a head performance recovery unit 14. The medium supply unit 11 automatically feeds sheets, of e.g. paper, as a print medium (not shown) into the interior of the ink jet printing apparatus. The medium transport unit 13 transports the print medium, supplied one sheet at a time from the medium supply unit 11, along a subscan direction of arrow B to a desired print position, from which the unit 11 further leads the print medium to a medium discharge unit 12. The printing unit prints on the print medium fed to the print position. The head performance recovery unit 14 executes a performance recovery operation on the printing unit.

The printing unit includes a carriage 16, supported on a carriage shaft 15 so that it can be moved in a main scan direction of arrow A, and a head cartridge 18 (see FIG. 15) removably mounted on the carriage 16 through a head set lever 17. The main scan direction crosses the subscan direction (at right angles in this example).

The carriage 16 on which the head cartridge 18 is mounted has a carriage cover 20 and a head set lever 17. The carriage cover 20 positions a print head 19 of the head cartridge 18 at a predetermined mounting position on the carriage 16. The head set lever 17 engages with a tank holder 21 formed integral with the print head 19 in a way that sets the print head 19 at the predetermined mounting position. Another engagement portion of the carriage 16 with the print head 19 is connected with one end of a contact flexible print cable (also referred to as "contact FPC") 22. A contact portion, not shown, formed at one end of this contact FPC 22 comes into electric contact with a contact portion 23 that constitutes an external signal input terminal formed on the print head 19. Through these contacts, information for a printing operation is transferred and electricity supplied to the print head 19.

Between the contact portion of the contact FPC 22 and the carriage 16 is provided an elastic member (not shown), such as rubber. The elastic force of this elastic member and the pressing force of the head set plate combine to make for a secure contact between the contact portion of the contact FPC 22 and the contact portion 23 of the print head 19. The other end of the contact FPC 22 is connected to a carriage printed circuit board, not shown, mounted on the back of the carriage 16.

The head cartridge 18 of this example includes an ink tank 24 storing ink and the print head 19 that ejects ink, supplied from this ink tank 24, from ejection openings according to the print information. The print head 19 of this example is a print head of a so-called cartridge type that is removably mounted on the carriage 16. In this example, six ink tanks 24 accommodating black, light cyan, light magenta, cyan, magenta and yellow inks respectively can be used to allow for printing of high-quality picture-like color images. Each of the ink tanks 24 is provided with an elastic removal lever 26 that can engage with the tank holder 21 to lock the ink tank 24. Operating this removal lever 26 lets each ink tank 24 be taken out of the tank holder 21, as shown in FIG. 15. The print head 19 includes an electric wiring board 28 and the tank holder 21.

(First Embodiment)

FIG. 1 to FIG. 4 show the ink jet print head in the first embodiment of this invention.

Figure 1:
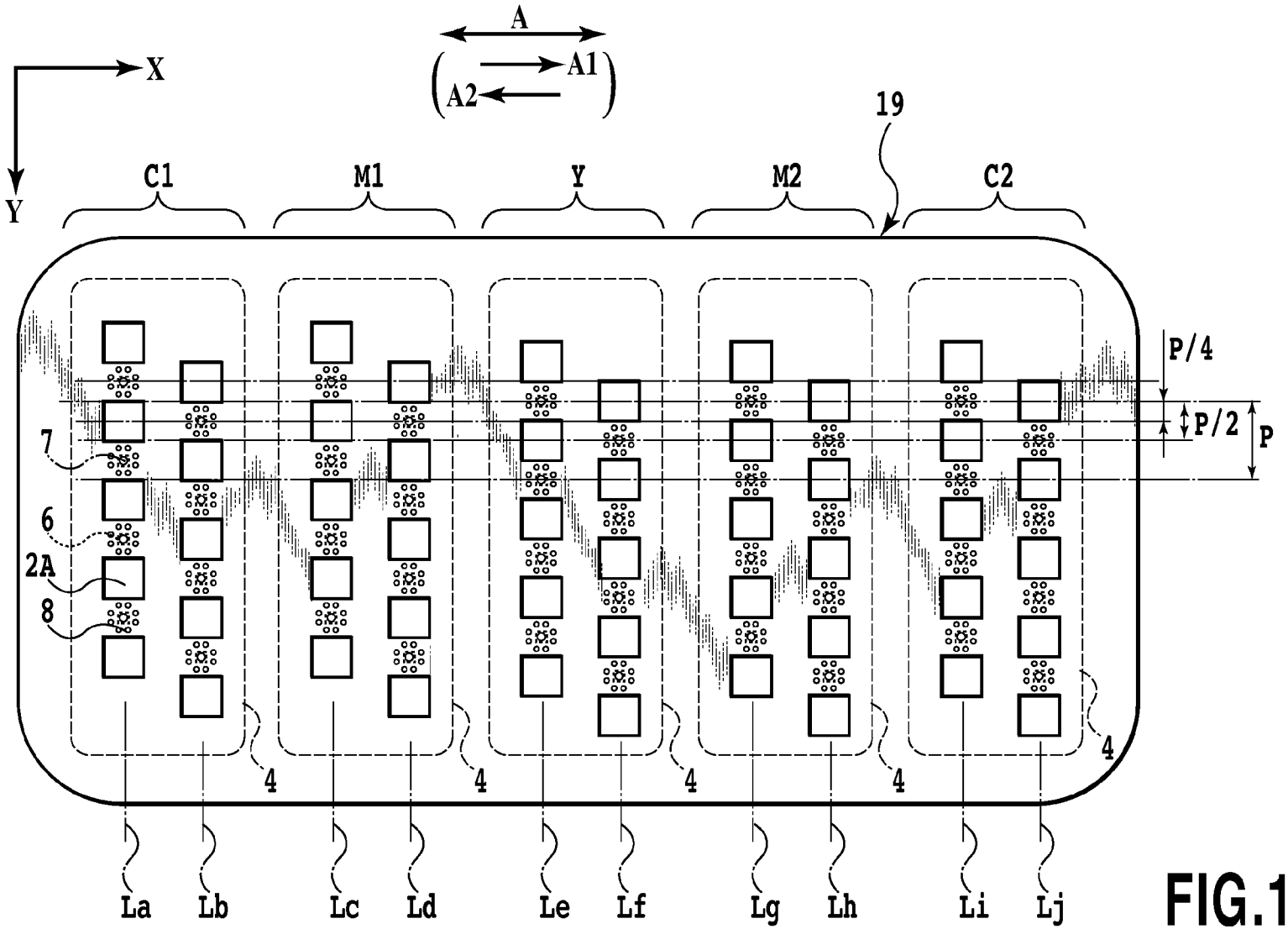
FIG. 1 is a plan view showing an essential portion of a print head of a first embodiment of this invention.

The print head 19 of this embodiment is formed with nozzle array groups C1, M1, Y, M2, C2, as shown in FIG. 1. The nozzle array groups C1 and C2 are cyan ink ejection nozzle array groups having two nozzle arrays La, Lb and two nozzle arrays Li, Lj, respectively. Nozzle array groups M1 and M2 are magenta ink ejection nozzle array groups having two nozzle arrays Lc, Ld and two nozzle arrays Lg, Lh, respectively. The nozzle array group Y is a yellow ink ejection nozzle array group having two nozzle arrays Le, Lf.

Figure 2:
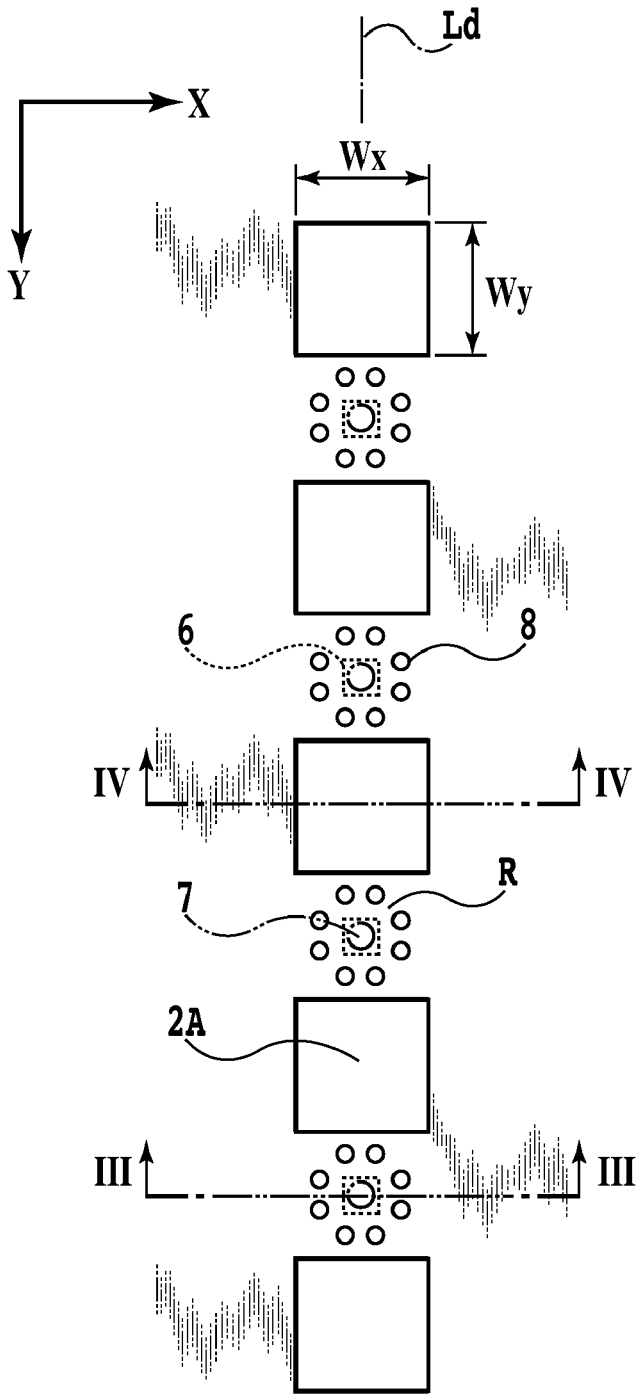
FIG. 2 is an enlarged view of a portion of one nozzle array of FIG. 1.
Figure 3:
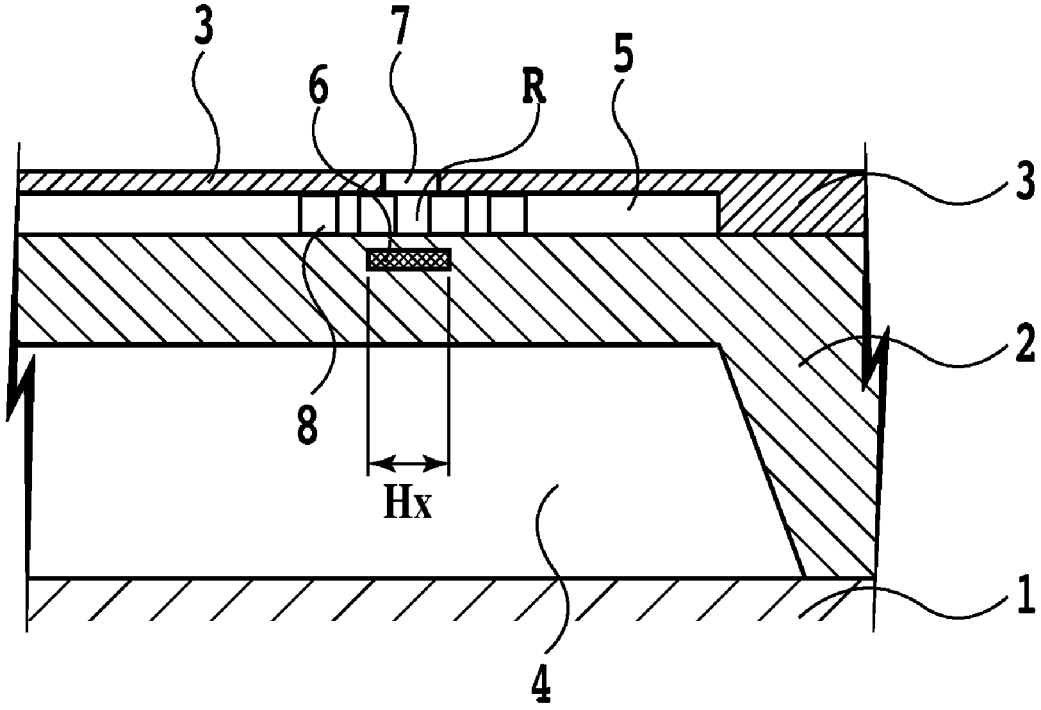
FIG. 3 is a cross-sectional view taken along the line III-III of FIG. 2.
Figure 4:
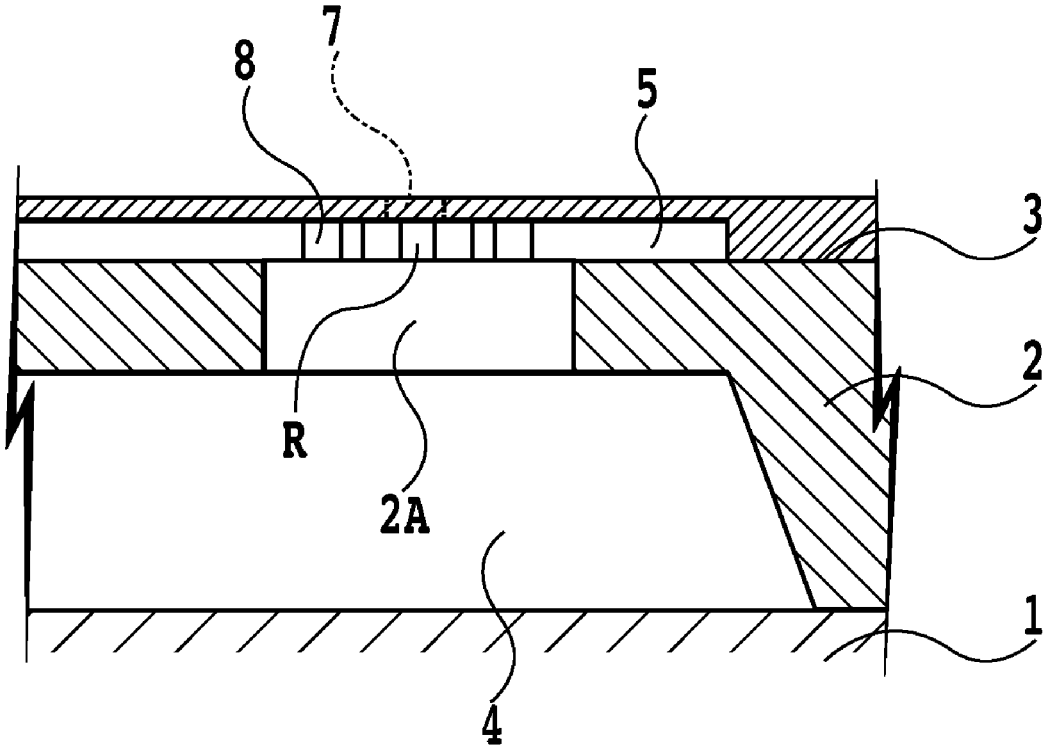
FIG. 4 is a cross-sectional view taken along the line IV-IV of FIG. 2.

FIG. 2 shows an enlarged view of the nozzle array Ld; FIG. 3 is a cross section taken along the line III-III of FIG. 2; and FIG. 4 is a cross section taken along the line IV-IV of FIG. 2. In these figures, reference numeral 1 denotes a support member, reference numeral 2 denotes a print head board and reference numeral 3 denotes an orifice plate. These members can be used commonly for all nozzle arrays in the print head 19. FIG. 1 and FIG. 2 are plan views with the orifice plate 3 removed.

A plurality of common liquid chambers 4 corresponding to each nozzle array group are formed between the support member 1 and the print head board 2. The plurality of common liquid chambers 4 are supplied with ink from their associated ink tanks. The ink in the common liquid chamber 4 is supplied through a plurality of supply ports 2A, cut through the print head board 2, into a liquid chamber 5 between the print head board 2 and the orifice plate 3. The plurality of supply ports 2A are lined along each of the nozzle arrays. The print head board 2 is provided with a plurality of electrothermal conversion elements (heaters) 6 arranged along each nozzle array. At those positions on the orifice plate 3 opposing the heaters 6 are formed ejection openings 7. The supply port 2A can be formed by etching technology. For example, it is preferable to form the supply port 2A by dry etching technology after forming the common liquid chamber 4 by wet etching technology.

In the nozzle array group M1, each of the nozzle arrays Lc, Ld has a plurality of heaters 6 and ejection openings 7 arranged at a predetermined pitch P. Further, the heaters 6 and ejection openings 7 of the nozzle array Lc and the heaters 6 and ejection openings 7 of the nozzle array Ld are staggered a half of the pitch (P/2) from each other. That is, the nozzle arrays Lc and Ld, each made up of the heaters 6 and ejection openings 7, are staggered a half of the pitch (P/2) from each other. Thus, images can be printed at two times the resolution that can be achieved with the pitch P of the ejection openings 7 in each of the nozzle arrays Lc, Ld. In each of the nozzle arrays Lc, Ld, the plurality of supply ports 2A are arranged at the same pitch as those of the heaters and ejection openings 7, and are situated between the heaters 6. As described above, the supply ports 2A are arranged along the nozzle arrays Lc, Ld so in other words each nozzle array Lc and Ld comprises alternating heaters 6 and supply ports 7 in the Y direction. The above construction also applies to other nozzle array groups C1, Y, M2, C2.

The cyan ink ejection nozzle array group C1 or C2 and the magenta ink ejection nozzle array group M1 or M2 are arranged on either side of the yellow ink ejection nozzle array group I that is situated at the center of the print head 19, as shown in FIG. 1. The print head with this arrangement can cope with a so-called bidirectional printing. That is, by ejecting yellow, cyan and magenta inks in the same order when the print head moves in the forward and backward directions (arrows A1 and A2), it is possible to produce high-quality images with reduced color variations also in the bidirectional printing. The heaters 6 and ejection openings 7 of the nozzle array group C1 and the heaters 6 and ejection openings 7 of the nozzle array group C2 are staggered by one-fourth the pitch P, or P/4. That is, the nozzle array groups C1 and C2, each made up of the heaters 6 and ejection openings 7, are staggered by one-fourth the pitch P, or P/4. Likewise, the nozzle array groups M1 and M2, each made up of the heaters 6 and ejection openings 7, are shifted by one-fourth the pitch P, or P/4.

That part of the liquid chamber 5 which lies between the heater 6 and the ejection opening 7 constitutes a heat application portion R, which is supplied with the ink from the common liquid chamber 4 through mainly the supply ports 2A formed immediately on the upper and lower sides of the heat application portion R in FIG. 2. Around the heat application portion R there is a nozzle filter 8. The nozzle filter 8 of this embodiment is formed of a plurality of columns situated between the print head board 2 and the orifice plate 3, with their gaps (size of openings of the nozzle filter or in particular the distance between adjacent columns) smaller than the diameter of the ejection openings 7 and preferably smaller than the minimum diameter of the ejection openings where the diameter of each ejection opening varies. This structure prevents foreign matter larger than the ejection openings 7 from getting into the heat application portions R. In this embodiment, only the nozzle filter 8 is installed between the heat application portion R and the supply port 2A, with no flow path wall provided there.

Assuming that the direction of array of a plurality of heat application portions R (direction of the nozzle array or ejection opening array) is a Y direction and the direction crossing the Y direction at right angles is a X direction, an opening size Wy of the supply ports 2A in the Y direction is larger than the inner diameter of the ejection openings 7. An opening size Wx of the supply ports 2A in the X direction is greater than the length Hx of the heaters 6 in the X direction. A resistance against ink flow from the heat application portion R to the plurality of supply ports 2A adjacent to it in the Y direction (Y direction flow resistance) is set smaller than a resistance against ink flow from the heat application portion R in the X direction (X direction flow resistance).

The print head 19 of this construction can energize the heaters 6 according to print data to generate a bubble in ink within the heat application portions R and, using the energy of the expanding bubble, eject ink in the heat application portion R from the ejection openings 7. After the ink ejection, the heat application portions R are refilled with ink from the common liquid chamber 4 through the supply ports 2A. If such a print head 19 is applied to the serial scan type ink jet printing apparatus of FIG. 13 to FIG. 15, images may be printed as follows. An operation of ejecting ink from the ejection openings 7 as the print head 19 is moved in the main scan direction and an operation of transporting the print medium in the subscan direction are alternated repetitively to print an image on the print medium.

The heat application portions R can be refilled with ink smoothly from the two supply ports 2A formed adjacent each heat application portion R on its upper and lower sides in FIG. 2. Further, since no flow path wall is provided between the heat application portion R and the supply ports 2A, with only the nozzle filter 8 installed there and since the opening size Wy of the supply ports 2A is set larger than the inner diameter of the ejection openings 7, a sufficient amount of ink supplied from the supply ports 2A to the heat application portion R can be secured. This can reduce the flow resistance of ink supplied to the heat application portions R, increasing the refill frequency, which in turn allows for increasing the ink ejection frequency and therefore the throughput. Further, where the nozzle array group is constructed of two nozzle arrays as in this embodiment, the heat application portions R can also be refilled with ink from a supply port 2A adjacent to the heat application portions R on the right or left side in FIG. 1, in addition to the supply ports 2A adjacent to the heat application portions R on the upper and lower sides in FIG. 1. This allows for a further increase in the ink ejection frequency and a higher throughput.

Since the opening size Wx of the supply ports 2A in the X direction is set greater than the length Hx of each heater 6 in the X direction, ink can be supplied smoothly. That is, after the ink inside the heat application portion R is ejected by the expanding bubble in ink over the heater 6, the heat application portion R above the heater 6 can be supplied with ink more smoothly from the supply ports 2A which are wider in the X direction than the heater 6. Furthermore, since the Y direction flow resistance of ink flowing from the heat application portion R to the supply ports 2A adjacent to the heat application portion R is smaller than the X direction flow resistance of ink flowing in the X direction from the heat application portion R, the pressure of the bubble generated over the heater 6 to eject ink is efficiently absorbed by the supply ports 2A adjacent to the heat application portion R in the Y direction. Therefore, the deleterious effects of so-called crosstalk, a phenomenon in which the pressure of ink bubbles produced in the heat application portions R adjacent to each other in the nozzle array direction interact with each other, can be alleviated. Further, where the nozzle array group is constructed of two nozzle arrays as in this embodiment, the bubble pressure in the heat application portion R can be absorbed not only by the two supply ports 2A adjacent to the heat application portion on the upper and lower sides in FIG. 1, but also by a supply port 2A adjacent to the heat application portion R on the right or left side in FIG. 1. Therefore, crosstalk can be reduced not only between the heat application portions R adjacent in the X direction, but also between the heat application portions R adjacent in the Y direction. Further, because the opening size Wx of the supply ports 2A in the X direction is set larger than the length Hx of the heaters 6 in the X direction, the pressure generated at the time of ink ejection can be absorbed reliably by the supply ports 2A, contributing to a reduction in crosstalk. Further, the fact that the opening size Wy of the supply ports 2A in the Y direction is set greater than the length Hy in the Y direction of the heaters 6 adjacent the supply ports 2A in the X direction similarly reduces the crosstalk. With these arrangements, it is possible to achieve both an improved ink refilling efficiency and reduced crosstalk, which are generally considered incompatible with each other.

Since foreign matter such as dirt coming in from the supply ports 2A is blocked by the nozzle filter 8 from entering into the heat application portion R, an appropriate ink ejection condition is stably maintained. Further, because the supply ports 2A are situated between the adjacent heat application portions R in the nozzle array direction, the supply ports 2A are shared by the neighboring heat application portions R. Therefore, when compared with a construction in which a plurality of supply ports are provided for each of individual heat application portions, this embodiment can reduce the size of the print head board 2, contributing to a size reduction of the print head.

As described above, the construction of this embodiment can increase the ink ejection frequency to improve throughput and also efficiently absorb the pressure generated in the heat application portions by the supply ports, preventing possible crosstalk among the heat application portions, which in turn makes for a high-speed printing of high-quality images. Further, by having each nozzle array group constructed of two nozzle arrays as shown in FIG. 1, highly defined images can be formed by a bidirectional printing.

(Second Embodiment)

Figure 5:
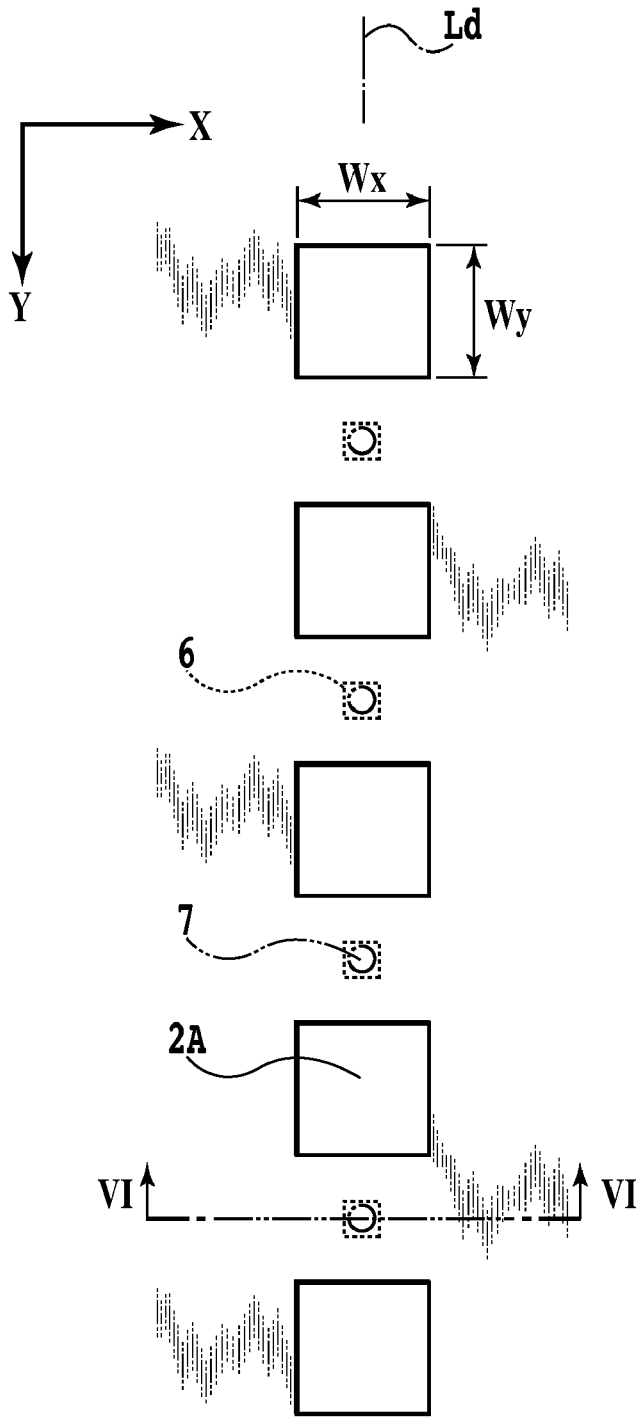
FIG. 5 is an enlarged view of a portion of one nozzle array in a second embodiment of this invention.
Figure 6:
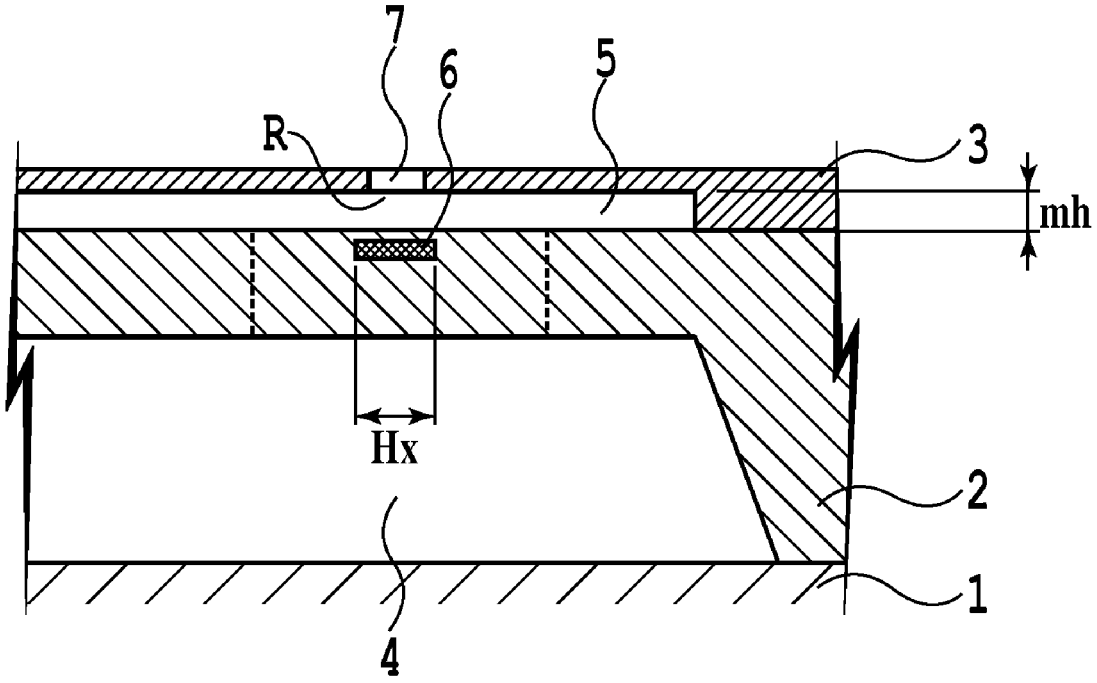
FIG. 6 is a cross-sectional view taken along the line VI-VI of FIG. 5.

FIG. 5 and FIG. 6 show a second embodiment of this invention, with components corresponding to those of the preceding embodiment assigned like reference numerals and not given detailed explanations.

In this example, the height mh of the liquid chamber 5 between the print head board 2 and the orifice plate 3 is set smaller than the inner diameter of the ejection opening 7. The nozzle filter 8 of the first embodiment is not provided. Since the height mh of the liquid chamber 5 is smaller than the inner diameter of the ejection opening 7, foreign matters larger than the ejection opening 7 cannot enter into the liquid chamber 5, blocking foreign substances from getting into the heat application portion R. The liquid chamber 5, though its height mh is low, does not produce so high an ink flow resistance because there are no flow path walls nor nozzle filters. It is therefore possible to maintain a high ink refill frequency, as in the first embodiment.

(Third Embodiment)

Figure 7:
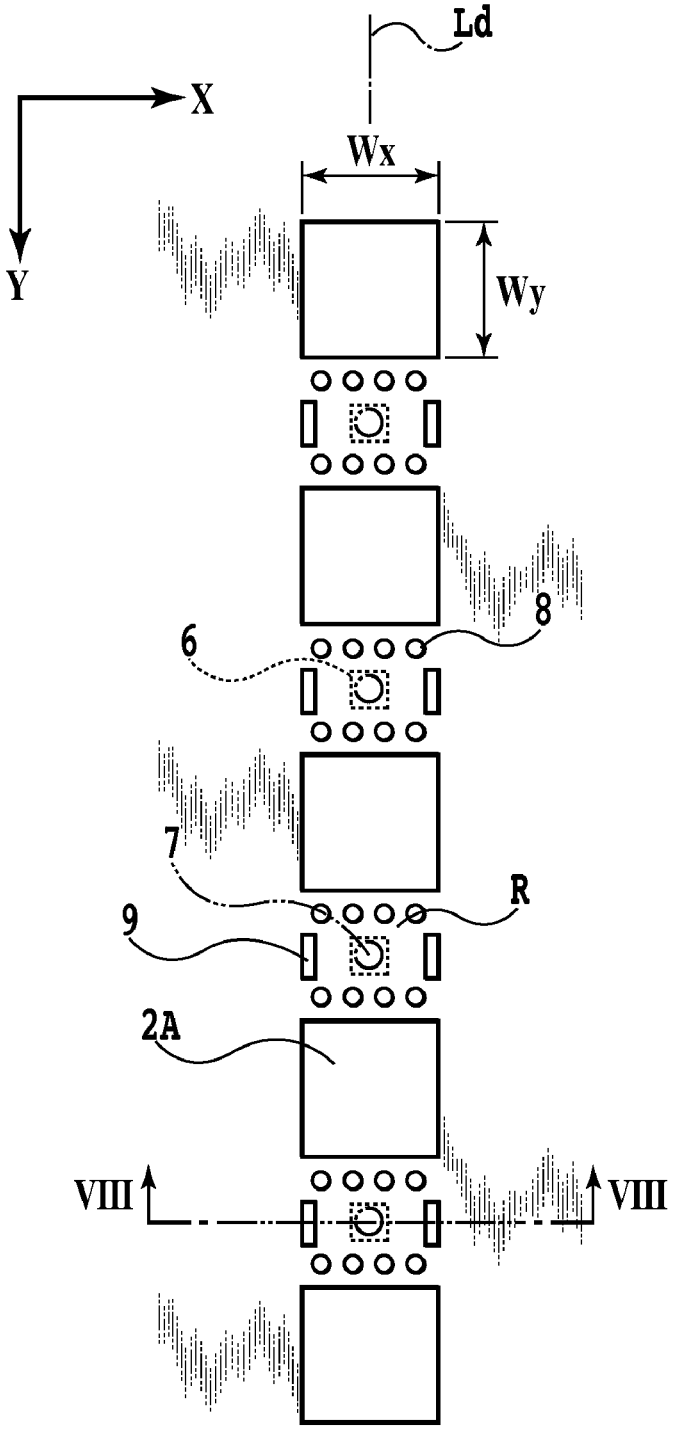
FIG. 7 is an enlarged view of a portion of one nozzle array in a third embodiment of this invention.
Figure 8:
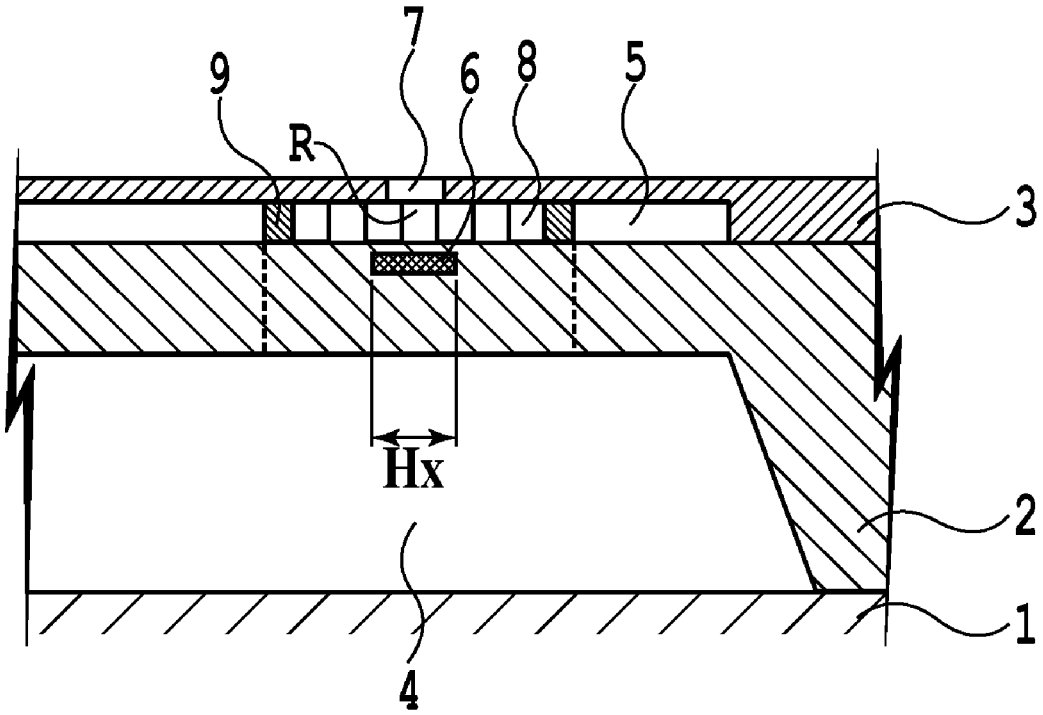
FIG. 8 is a cross-sectional view taken along the line VIII-VIII of FIG. 7.

FIG. 7 and FIG. 8 show a third embodiment of this invention, with components corresponding to those of the preceding embodiments assigned like reference numerals and not given detailed explanations.

In this example, a pair of flow path walls 9 are installed in the liquid chamber 5 at positions on both sides, in the X direction, of the heat application portion R. These flow path walls 9 are parallel in the Y direction and their distance (separation) in the X direction is about the same as the X direction size Wx of the supply ports 2A. The flow path walls 9 are situated sufficiently remote from the heater 6, so that the X direction ink flow resistance can be made extremely high without increasing the Y direction ink flow resistance so much. This, in turn, allows for reducing crosstalk between heat application portions R more effectively while maintaining a high refill frequency, as in the preceding embodiments.

(Fourth Embodiment)

Figure 9A:
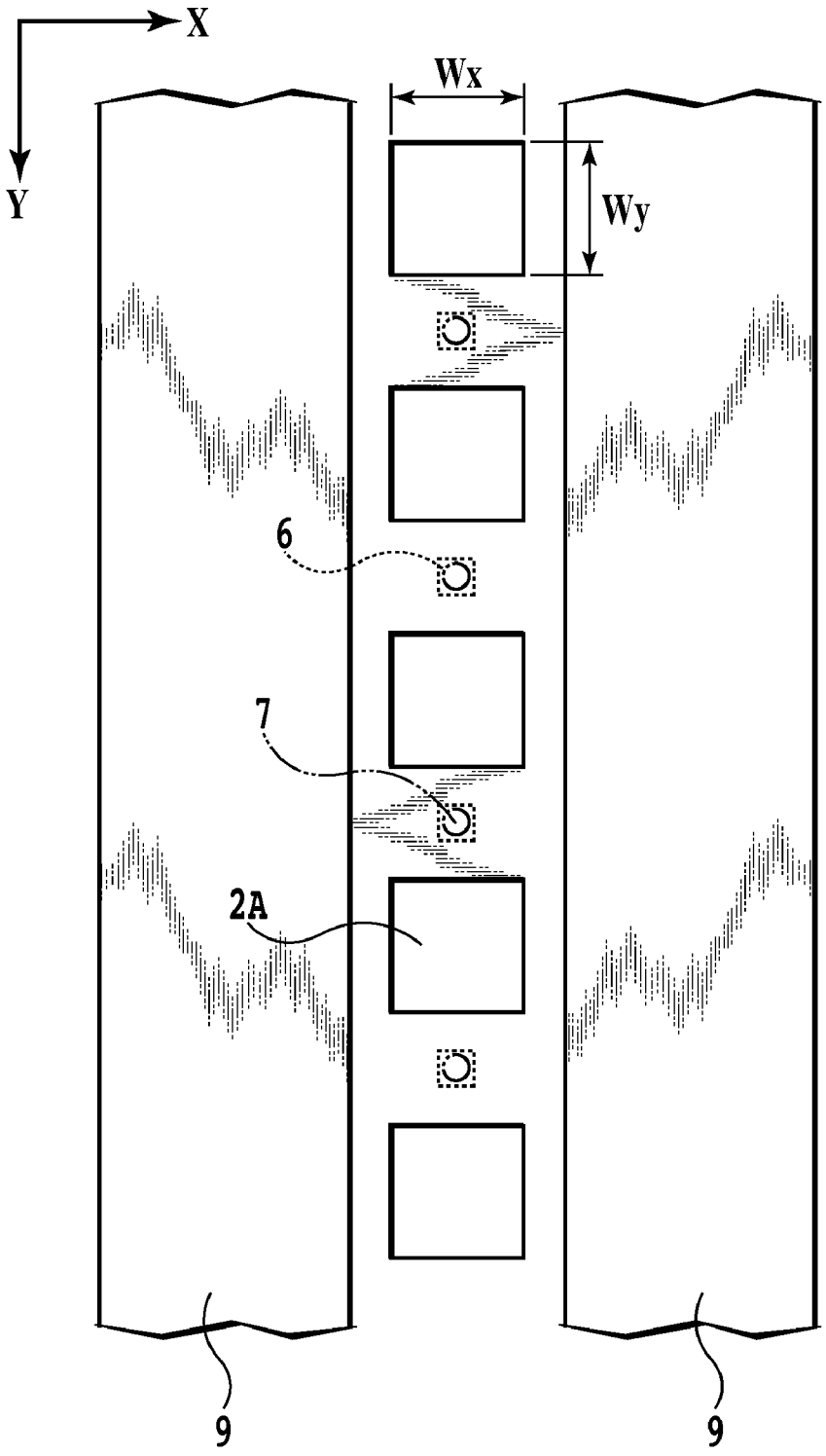
FIGS. 9A, 9B and 9C are enlarged views of portions of nozzle arrays in a fourth embodiment of this invention.
Figure 9B:
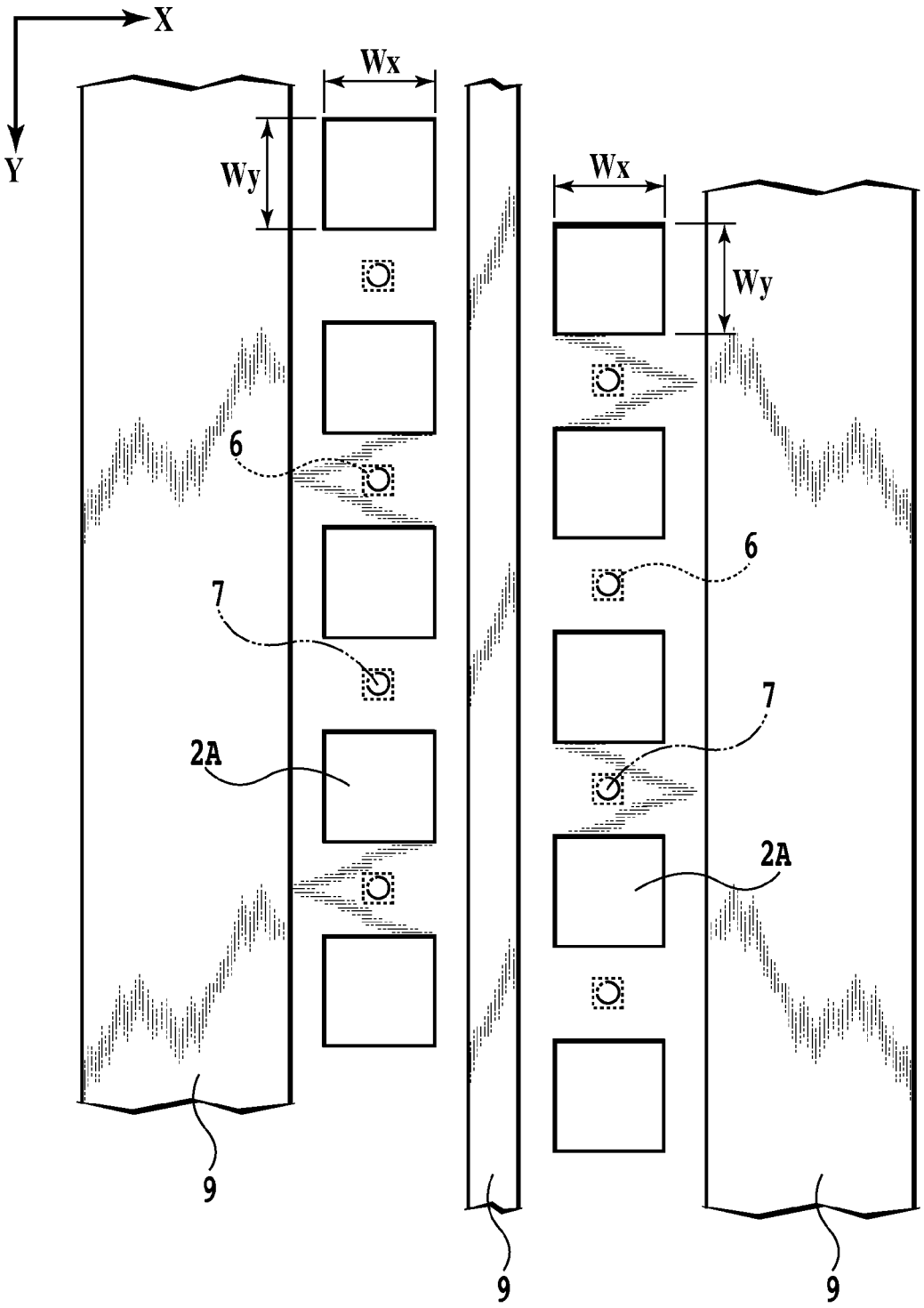
Figure 9C:
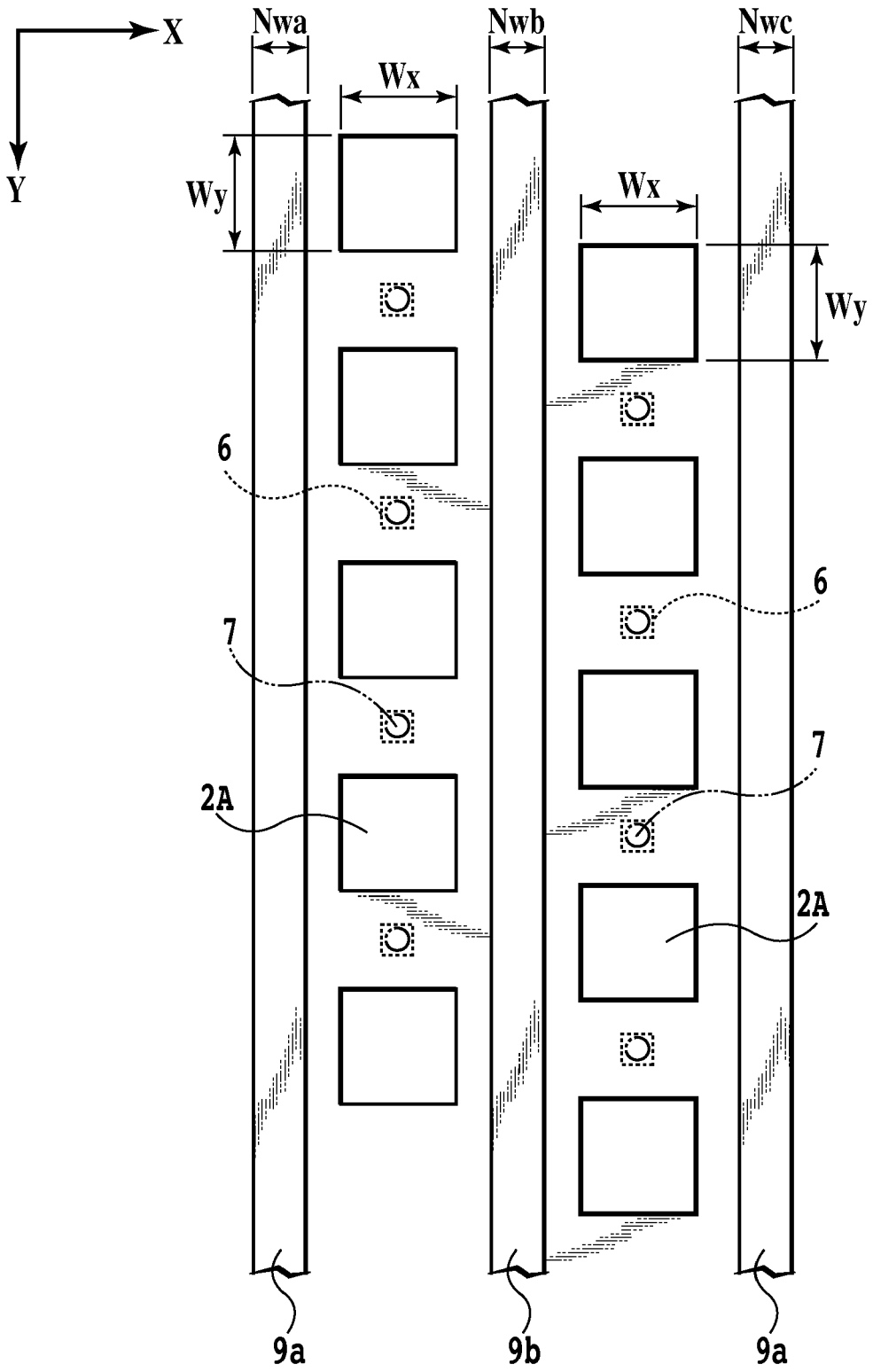

FIG. 9A to FIG. 9C show a fourth embodiment of this invention, with components corresponding to those of the preceding embodiments assigned like reference numerals and not given detailed explanations.

In this embodiment, FIG. 9A shows a single nozzle array. In FIG. 9A, on both sides of the nozzle array there are flow path walls 9 extending along the length of the nozzle array. The flow path walls 9 formed continuously along the nozzle array can reduce crosstalk effects even further than in the preceding embodiments.

Further, where a plurality of nozzle arrays are arranged side by side as shown in FIG. 9B, a flow path wall 9 may be installed between the nozzle arrays to mitigate the crosstalk between the adjacent nozzle arrays. Another feature of this embodiment is that since the orifice plate 3 is supported by the flow path walls 9 over its entire area in the nozzle array direction, it has an increased strength. So, the orifice plate 3 is made less susceptible to damage when it is subjected to a pressure of cleaning water applied to a print head board as the print head board is sliced from a wafer during the manufacturing process, or to a contact pressure of a wiping blade acting on the surface of the print head during a printing operation, or to an impact force generated by a print medium striking the surface of the print head. Further, the bonding area of the flow path walls 9 with the print head board has increased substantially, making the flow path walls 9 difficult to remove from the print head board, which is desirable.

In FIG. 9C a width Nwa and Nwc of flow path walls 9*a* formed outside the adjacent nozzle arrays is set equal to a width Nwb of an inter-nozzle flow path wall 9*b*. This makes the stresses accumulated inside the flow path walls 9*a*, 9*b* during the manufacturing process equal, so that the orifice plate 3 is applied almost uniform stresses over its entire area, stabilizing the shape of the ejection openings 7 and their surrounding areas. As a result, high-precision ejection openings can be formed, which in turn stabilizes the direction of ejection of ink droplets, assuring stable high-quality printing.

(Fifth Embodiment)

Figure 10A:
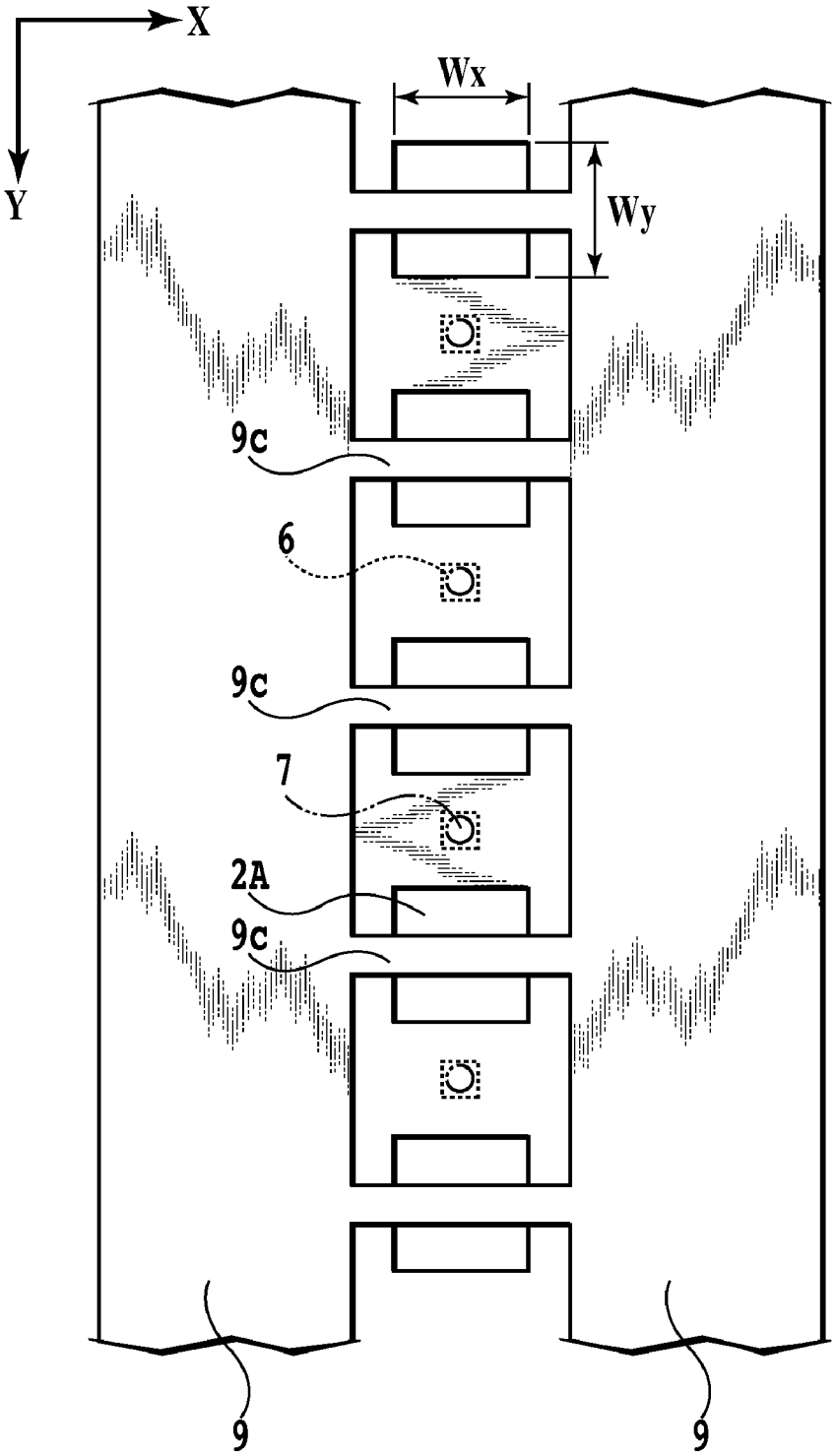
FIGS. 10A and 10B are enlarged views of portions of nozzle arrays in a fifth embodiment of this invention.
Figure 10B:
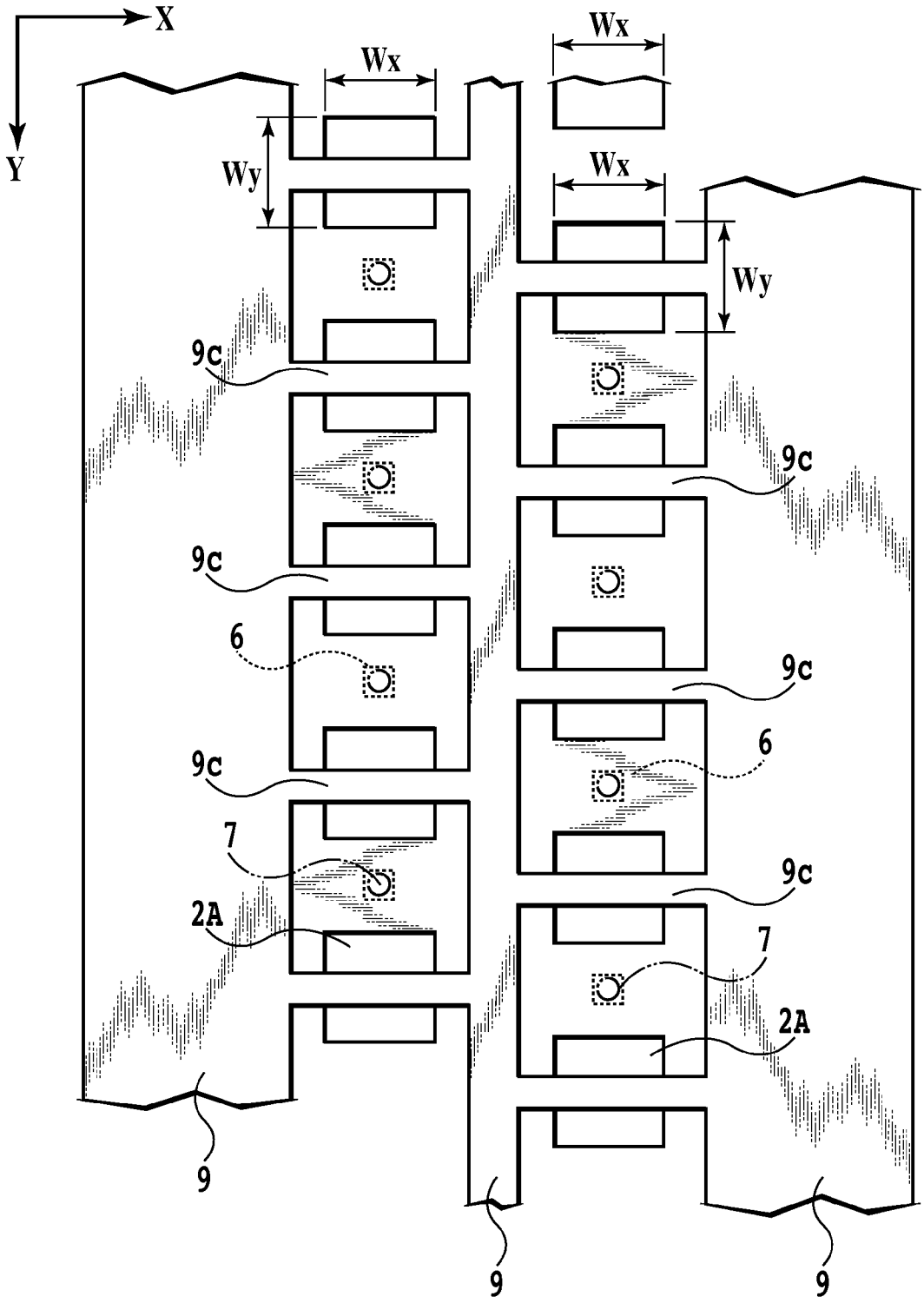

FIG. 10A and FIG. 10B show a fifth embodiment of this invention, with components corresponding to those of the preceding embodiments assigned like reference numerals and not given detailed explanations.

FIG. 10A shows an example construction of a single nozzle array. In FIG. 10A, continuous flow path walls 9 are provided running along the nozzle array. Also between the heat application portions R there are flow path walls 9C straddling over the supply ports 2A in the X direction. This construction can more effectively suppress crosstalk between the adjacent heat application portions R in the same nozzle array, without degrading the refilling performance. Further, since the orifice plate 3 is also supported by flow path walls 9C running between the adjacent heat application portions F in the same nozzle array, its strength is further improved. The similar arrangement can also be applied to a print head having a plurality of nozzle arrays as shown in FIG. 10B.

(Sixth Embodiment)

Figure 11A:
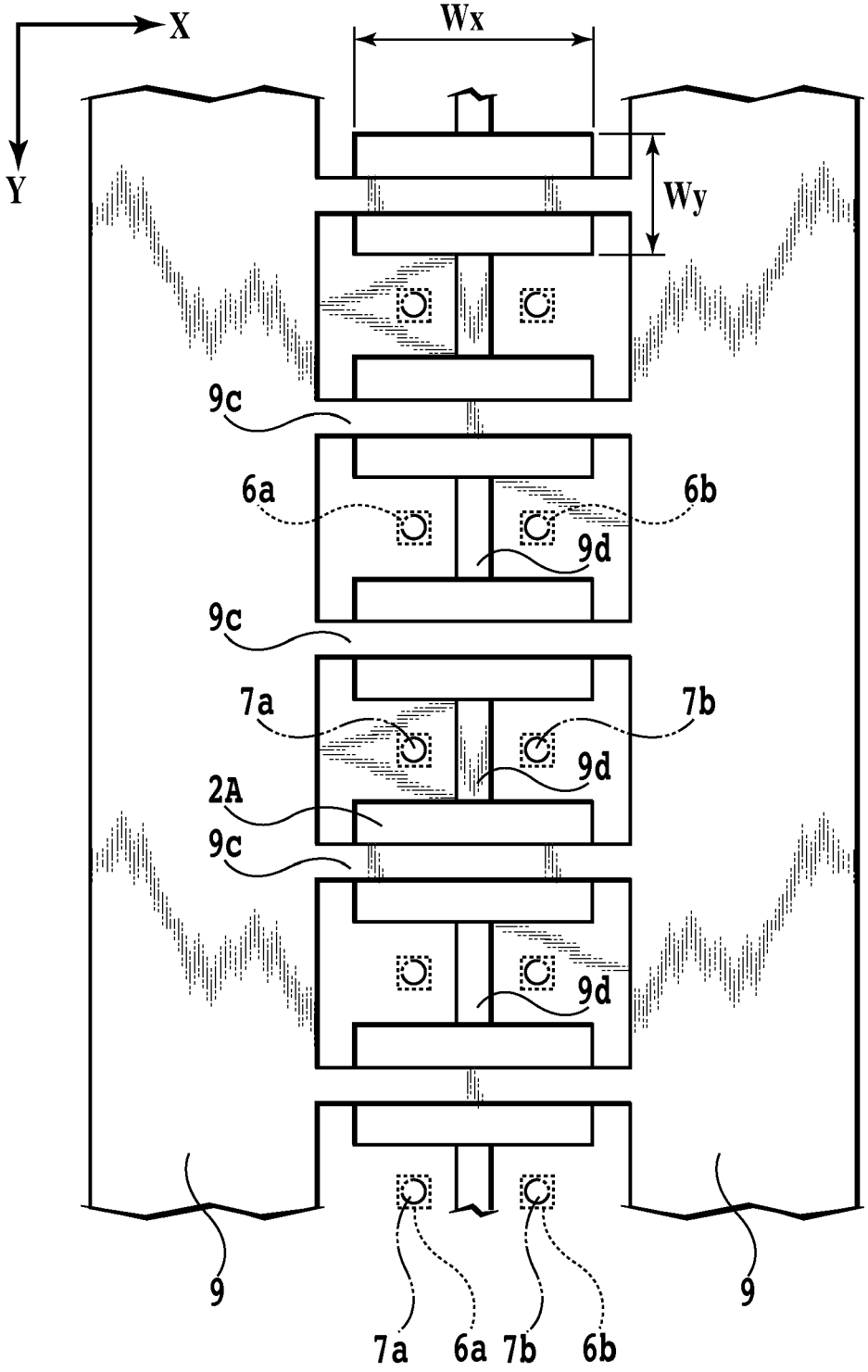
FIGS. 11A and 11B are enlarged views of portions of nozzle arrays in a sixth embodiment of this invention.
Figure 11B:
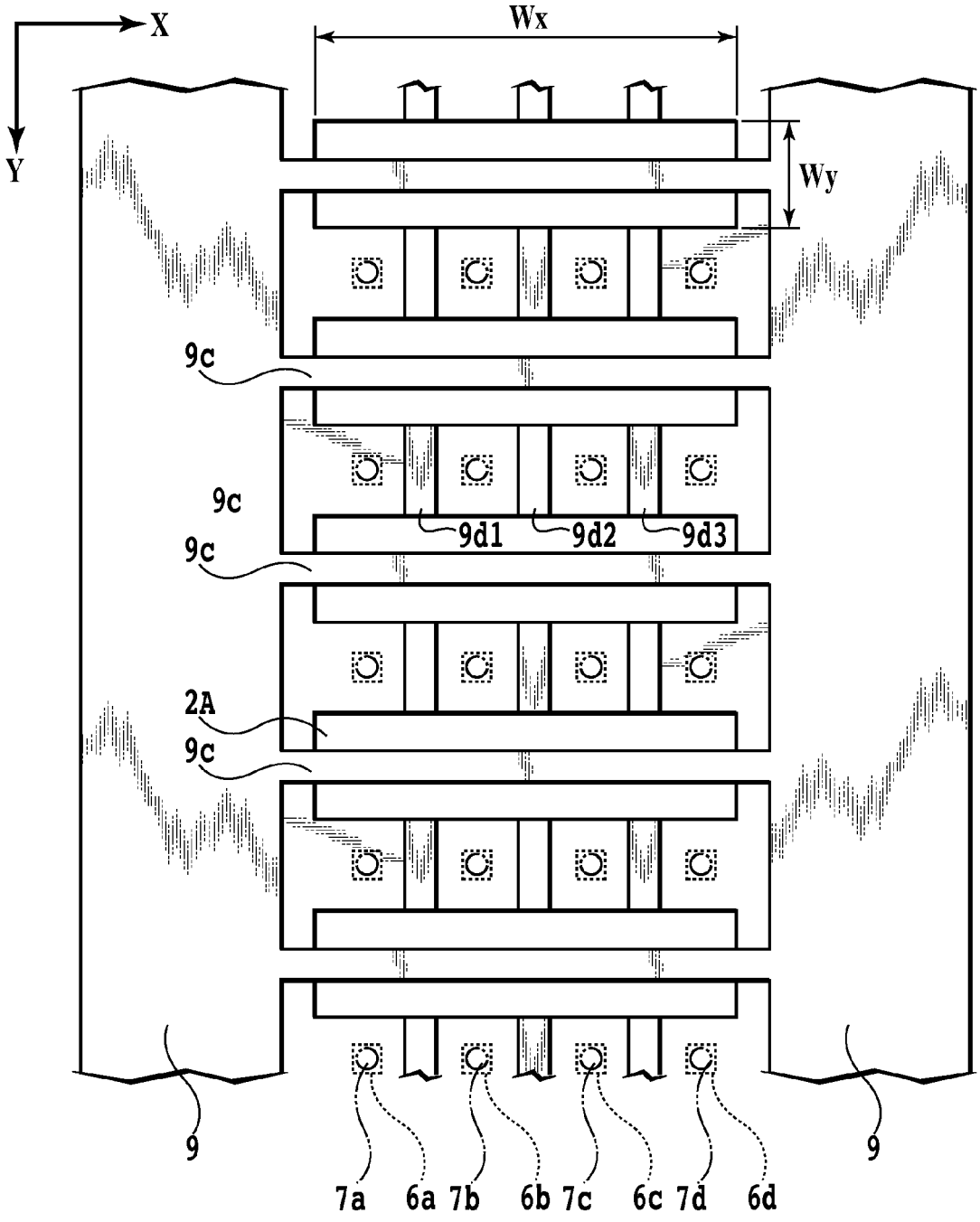

FIG. 11A and FIG. 11B show a sixth embodiment of this invention, with components corresponding to those of the preceding embodiments assigned like reference numerals and not given detailed explanations.

FIG. 11A shows two heaters (6*a*, 6*b*) and two ejection openings (7*a*, 7*b*) positioning between the adjacent supply ports 2A and added to the fifth embodiment such that a single supply port is alternated in the Y direction with a pair of heaters and ejection openings arrayed in the X direction. Flow path walls 9*d* are installed between a combination of heater 6*a* and ejection opening 7*a* and a combination of heater 6*b* and ejection opening 7*b*. This arrangement can effectively suppress crosstalk between the heater 6*a* and the heater 6*b* while at the same time allowing the same supply port 2A to be shared by the two heaters. This in turn allows for doubling the number of nozzle arrays while maintaining a good ejection state and keeping the print head board small in size. These advantages contribute to a low-cost, high-performance print head being achieved.

FIG. 11B shows an example construction in which four heaters (6*a*, 6*b*, 6*c*, 6*d*) and four ejection openings (7*a*, 7*b*, 7*c*, 7*d*) (arrayed in the X direction) are provided on the print head board between a plurality of supply ports (arrayed in the Y direction) such that a single supply port is alternated in the Y direction with an array of four heaters and four ejection openings extending in the X direction. Flow path walls 9*d*1, 9*d*2, 9*d*3 formed between a combination of heater 6*a* and ejection opening 7*a* and a combination of heater 6*b* and ejection opening 7*b*, between the combination of heater 6*b* and ejection opening 7*b* and a combination of heater 6*c* and ejection opening 7*c*, and between the combination of heater 6*c* and ejection opening 7*c* and a combination of heater 6*d* and ejection opening 7*d*. This arrangement allows for quadrupling the number of nozzle arrays while keeping the print head board small in size, which in turn enables a high-performance head with an even higher cost performance to be realized. Although this embodiment has been described with reference to two or four combinations of heater and ejection opening being positioned between the supply ports, the invention is not limited to these particular configurations.

(Seventh Embodiment)

Figure 12A:
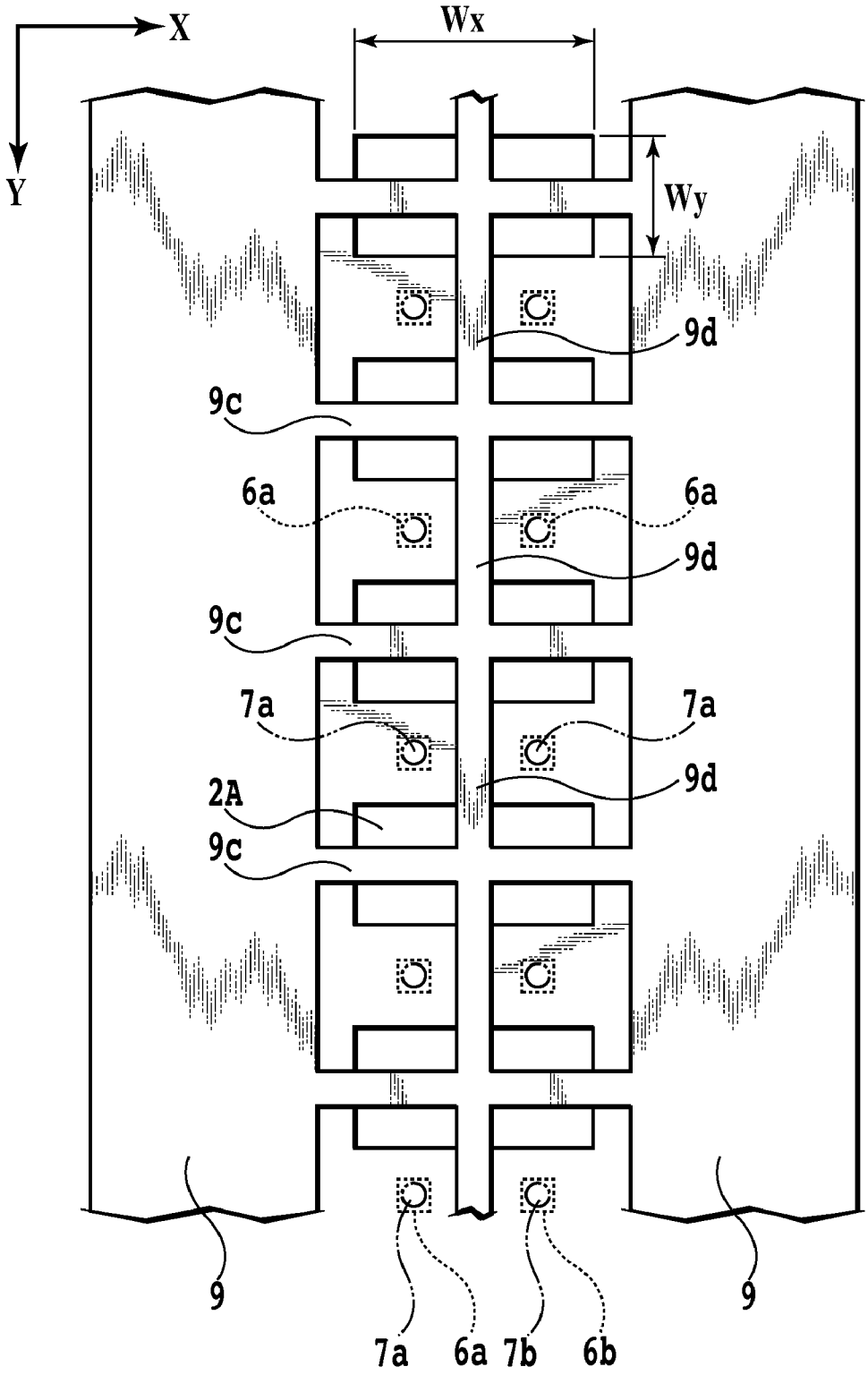
FIGS. 12A and 12B are enlarged views of portions of nozzle arrays in a seventh embodiment of this invention.
Figure 12B:
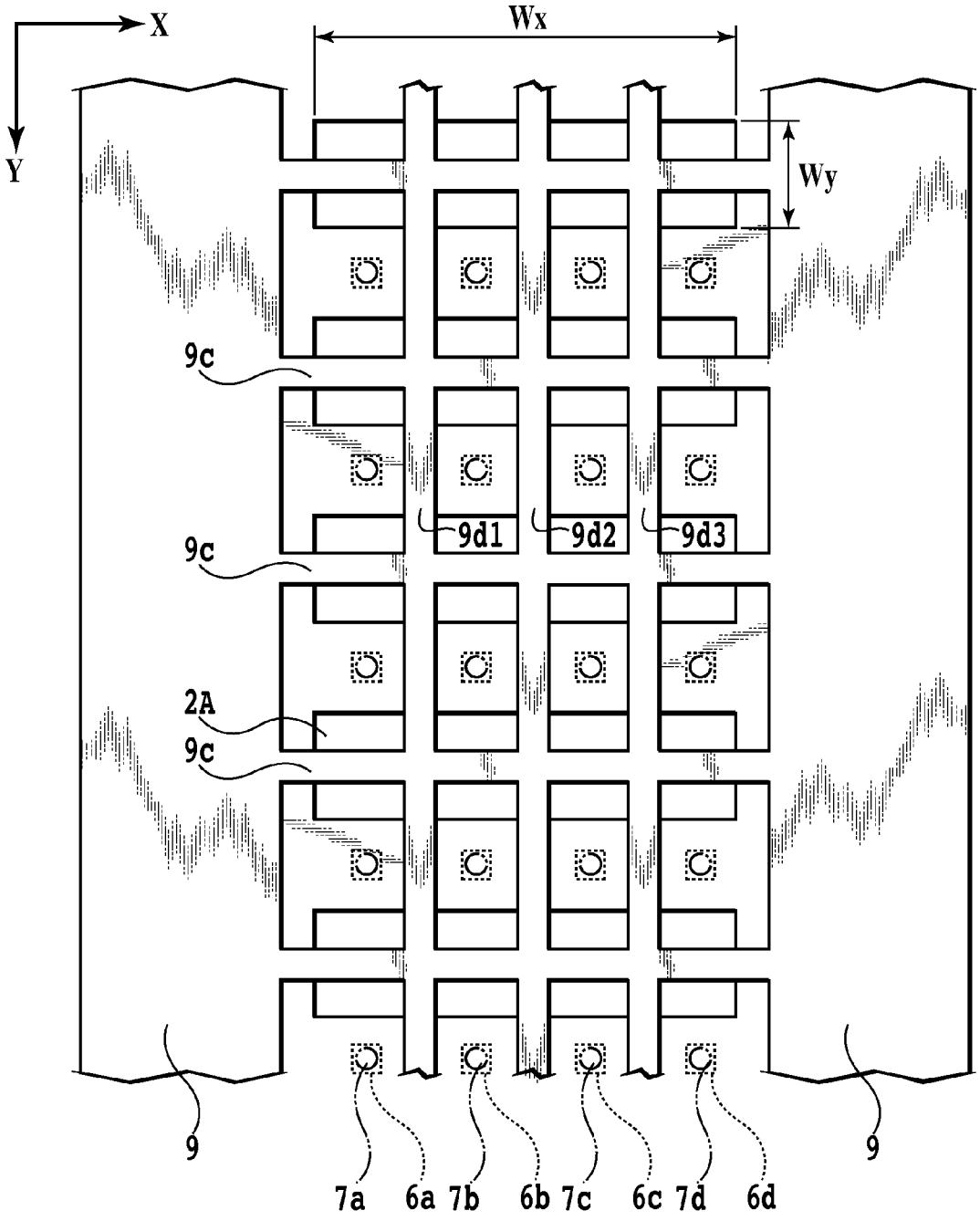

FIG. 12A and FIG. 12B show a seventh embodiment of this invention, with components corresponding to those of the preceding embodiments assigned like reference numerals and not given detailed explanations.

This embodiment differs from the sixth embodiment in that the flow path walls 9*d*1, 9*d*2, 9*d*3 are connected to the flow path walls 9*c*. This arrangement can further reduce crosstalk among a plurality of heaters that are installed between the same two supply ports 2A, assuring a further stabilized ejection, thereby realizing a print head with high performance and reliability.

(Other Embodiments)

The ink jet print head of this invention needs only to have arrayed in a predetermined direction a plurality of heat application portions that are supplied ink through supply ports and each of the heat application portions can eject ink from an ejection opening using thermal energy of an electrothermal conversion element. This invention therefore can be applied to a wide range of ink jet print heads of this construction, including those for use in the aforementioned serial scan type ink jet printing apparatus and a so-called full-line type ink jet printing apparatus.

A plurality of supply ports need only to be arranged along the direction of array of heat application portions so that the supply ports alternate with the heat application portions in the heat application portion array direction. The supply ports also need to have their opening size in a direction perpendicular to the heat application portion array direction set greater than the length in the same direction of electrothermal conversion elements or heaters. Therefore the shapes of the supply ports and the heaters are not limited to those of the above-mentioned embodiments.

The flow resistance of ink flowing from a heat application portion toward an adjacent supply port in the predetermined array direction is set smaller than the flow resistance of ink flowing from the heat application portion in a direction perpendicular to the direction of array of heat application portions. This arrangement enables the pressure within the heat application portion to be absorbed efficiently by the supply ports. Further, by setting the opening size of the supply ports in the direction of array of heat application portions greater than the inner diameter of the ejection openings, the supply ports can be made large to absorb the pressure of the heat application portions more efficiently. Further, by arranging the heat application portions and the supply ports so that they are adjacent in a direction perpendicular to the direction of array of heat application portions, as shown in FIG. 1, the pressure within the heat application portions can be absorbed also by the supply ports positioned adjacent in that direction.

The plurality of heat application portions may be placed on the same print head board and communicated fluidly with one another, and the plurality of supply ports may be cut through the board to supply to the heat application portions the ink in the common liquid chamber situated under the board (on the opposite side of the heater-formed surface of the board). With the board arranged in this way, the construction can be made simple and small.

Further, by putting between the supply ports and the heat application portions a throttled or constricted portion that forms an opening smaller than the inner or minimum diameter of the ejection openings, foreign matter, such as dirt larger than the ejection openings, can be blocked from getting into the heat application portions. The throttled portion may be the nozzle filter of the aforementioned embodiments. It is also possible to form heat application portions between the print head board and the ejection opening-formed orifice plate and set a gap between the board and the orifice plate smaller than the inner diameter of the ejection openings. This arrangement, too, can prevent possible entrance into the heat application portions of foreign matter, such as dirt, larger than the ejection openings.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application Nos. 2009-026169, filed Feb. 6, 2009, and 2010-007994, filed Jan. 18, 2010, which are hereby incorporated by reference herein in its entirety.

What is claimed is:

1. An ink jet print head having a plurality of heat application portions formed on a print head board and a plurality of supply ports penetrating through the print head board, wherein each of the heat application portions is supplied with ink from at least one of the supply ports and ejects the supplied ink from an associated ejection opening by using thermal energy of an electrothermal conversion element, wherein the supply ports and the heat application portions are arrayed in a predetermined direction so that at least one of the heat application portions are located between the respective supply ports, and wherein the opening size of at least one of the supply ports, in a direction perpendicular to the predetermined direction, is greater than the length of the electrothermal conversion elements in the direction perpendicular to the predetermined direction.

2. The ink jet print head according to claim 1, wherein the flow resistance to ink flowing from the heat application portion toward an adjacent supply port in the predetermined direction is smaller than a flow resistance to ink flowing from the heat application portion in the direction perpendicular to the predetermined direction.

3. The ink jet print head according to claim 1, wherein the opening size of at least one of the supply ports in the predetermined direction is greater than a minimum diameter of the associated ejection opening.

4. The ink jet print head according to claim 1, wherein the plurality of heat application portions are positioned on the print head board and in fluid communication with one another.

5. The ink jet print head according to claim 1, wherein a constricted portion that forms an opening smaller than the minimum diameter of its associated ejection opening is formed between the at least one heat application portion and an adjacent supply port.

6. The ink jet print head according to claim 1, wherein the heat application portions are formed between the print head board and an orifice plate, formed with the ejection openings; and wherein a gap between the print head board and the orifice plate is smaller than the minimum diameter of the ejection openings.

7. The ink jet print head according to claim 1, wherein a supply port adjacent to at least one heat application portion is provided in the direction perpendicular to the predetermined direction.

8. The ink jet print head according to claim 1, wherein a flow path wall, extending along the predetermined direction, is arranged adjacent to at least one heat application portion.

9. The ink jet print head according to claim 1, wherein a flow path wall extending in the direction perpendicular to the predetermined direction is arranged between two heat application portions arrayed in the direction, perpendicular to the predetermined direction.

10. The ink jet print head according to claim 9, wherein the flow path wall extending in the direction perpendicular to the predetermined direction extends over at least one supply port.

11. An ink jet print head comprising:

an orifice plate formed with a plurality of ejection openings;

a print head board at which a plurality of supply ports and a plurality of elements are linearly-arrayed alternately in a predetermined direction, each of the supply ports penetrating through the print head board, each of the elements generating thermal energy for ejecting ink, supplied through at least one of the supply ports, from an associated ejection opening, wherein the opening size of the supply ports positioned at each side of the element, in a direction perpendicular to the predetermined direction, is greater than the length of the elements located between the supply ports, in the direction perpendicular to the predetermined direction.

12. An ink jet print head according to claim 11, wherein the supply ports and the elements are arrayed alternately in a plurality of lines in the predetermined direction.

13. An ink jet print head according to claim 12, wherein the plurality of lines include a first line and a second line adjacent the first line in the direction perpendicular to the predetermined direction, wherein positions of the elements in the first line and positions of the elements in the second line are deviated from one another in the predetermined direction.

14. An ink jet print head according to claim 12, wherein the plurality of lines include a first line and a second line adjacent each other in the direction perpendicular to the predetermined direction, wherein positions of the supply ports in the first line and positions of the supply ports in the second line are shifted in the predetermined direction.

15. An ink jet print head according to claim 12, wherein a flow path wall is formed between the first line and the second line.

16. An ink jet print head according to claim 12, wherein a common liquid chamber is formed to communicate with the supply ports in the plurality of lines, the common liquid chamber being situated on a surface of the print head board opposite the other surface of the print head board facing the orifice plate.

17. The ink jet print head according to claim 11, further comprising flow path walls located on both sides of the element with respect to the direction perpendicular to the predetermined direction.

18. The ink jet print head according to claim 17, wherein the flow path walls extend in the predetermined direction.

19. An ink jet print head comprising:

an orifice plate formed with an ejection opening;

a board on which a first supply port, an element, and a second supply port are linearly-arrayed in a predetermined direction in that order, the first supply port being formed by a penetrating port for supplying a first ink to the ejection opening, the element generating thermal energy to be used to eject the first ink from the ejection opening, the second supply port formed by a penetrating port for supplying the first ink to the ejection opening, wherein the opening size of the first and second supply ports, in a direction perpendicular to the predetermined direction, is greater than the length of the element in the direction perpendicular to the predetermined direction.

* * * * *